US005305951A

United States Patent [19]

Kuhn et al.

[11] Patent Number: 5,305,951

[45] Date of Patent: Apr. 26, 1994

[54] ERECTABLE CONTAINER APPARATUS

[75] Inventors: Wayne H. Kuhn, Palos Park; Jeffrey S. James, Lisle, both of Ill.

[73] Assignee: Stone Container Corporation, Chicago, Ill.

[21] Appl. No.: 71,511

[22] Filed: Jun. 3, 1993

[51] Int. Cl.[5] ..... B65D 5/24

[52] U.S. Cl. ..... 229/105; 229/113; 229/157; 229/186

[58] Field of Search ..... 229/40, 105, 113, 155, 229/156, 157, 186

[56] References Cited

U.S. PATENT DOCUMENTS

| | | | |
|---|---|---|---|
| 923,111 | 5/1909 | Boberg | 229/157 |
| 1,760,106 | 5/1930 | Beach . | |
| 1,774,299 | 8/1930 | Stubbs et al. . | |
| 2,238,468 | 4/1951 | Hayden | 229/105 |
| 2,562,261 | 7/1951 | Collins | 229/40 |
| 2,987,237 | 6/1961 | Bemiss et al. | 229/40 |
| 3,027,063 | 3/1962 | Zastrow | 229/40 |
| 3,043,068 | 7/1962 | Blonder | 229/40 |
| 3,252,650 | 5/1966 | Pryor | 229/40 |
| 3,627,541 | 12/1971 | Farguhar | 229/40 |
| 4,917,291 | 4/1990 | Saiki et al. | 229/155 |

FOREIGN PATENT DOCUMENTS

| | | | |
|---|---|---|---|
| 463403 | 2/1914 | France | 229/155 |
| 1055548 | 2/1954 | France | 229/40 |
| 1238882 | 7/1960 | France | 229/40 |
| 417244 | 9/1944 | Italy | 229/40 |
| 261018 | 4/1949 | Switzerland | 229/40 |
| 299143 | 5/1954 | Switzerland | 229/155 |

*Primary Examiner*—Gary E. Elkins
*Attorney, Agent, or Firm*—Dick and Harris

[57] ABSTRACT

An erectable container apparatus constructed from a substantially square blank of material for use in releasably storing various articles therewithin. The apparatus includes a plurality of side panels each having an inner edge attached to a base portion, an outer edge attached to a corresponding top flap member, and a left and right edge. The left and right edges are operably positioned at acute angles relative to the respective inner edges to which they intersect so as to provide substantially upright and inwardly sloping side panels upon articulation of the erectable container apparatus toward and into its fully articulated orientation. Locking elements are operably associated with at least two of the top flap members for releasably locking the erectable container apparatus in a fully erected orientation, as well as to releasably maintain the top flap members and the inwardly sloping side panels in a base and article covering orientation.

14 Claims, 2 Drawing Sheets

ERECTABLE CONTAINER APPARATUS

BACKGROUND OF THE INVENTION

The present invention relates to article containment devices, and, more particularly, to an erectable container apparatus constructed from a substantially square blank of material for use in releasably storing various articles therewithin.

Article containment devices of the type constructed from a substantially square blank of material have been known in the art for many years. Typically, such prior art devices have included a base, four side panels attached to the base, and four flaps, or cover members, attached to a corresponding side panel. In addition, some of such prior art has also utilized webs, or corner members, attached to adjacently positioned side members, for substantially eliminating the spacial gap which would otherwise exist between the side panels after the device has been fully erected. Examples of such prior art include: Beach, U.S. Pat. No. 1,760,106; Stubbs et al., U.S. Pat. No. 1,774,299; Bemiss, U.S. Pat. No. 2,987,237; and Pryor, U.S. Pat. No. 3,252,650.

Other than Pryor, '650, none of the above-identified prior art containment devices teach, much less disclose, an erectable container apparatus having inwardly sloping side panels which result upon articulation of the container toward and into a fully erect orientation. Although Pryor, '650 does appear to disclose sloping side panels, among other differences to the present invention is that after articulation of the Pryor '650 reference, a portion of the side edges of the top flaps extend to hang over or overlap a portion of adjacently positioned side panels—thereby resulting in protrusions which could inadvertently catch, or snag, on an external object during manipulation of the fully erected container. Further, such a construction precludes clean, "mitered" edge abutment of the panels; of extreme importance to sanitary food containment or complete article enclosure.

It is thus an object of the present invention to provide an erectable container apparatus constructed from a substantially square blank of material so as to minimize the material waste associated with constructing such containers from other blank configurations.

It is also an object of the present invention to provide an erectable container apparatus having side panels with right and left ends positioned at acute angles relative to the inner and outer edges of the respective side panels from which they intersect, so as to provide substantially upright and inwardly folded side panels which, in combination with corresponding top flaps, collectively serve to cover the base portion of the apparatus at abutting edges—without resulting in excessive overhanging of the top flaps after the apparatus has been articulated into its fully erected orientation.

It is still further an object of the present invention to provide an erectable container apparatus which is relatively simple and inexpensive to manufacture, as well as which is simple to erect into its articulated shape.

Yet another object of the present invention is to provide an erectable container apparatus which is lockable, and alternatively releasable, to and from its fully erected orientation respectively without having locking means requiring enlargement of the required blank shape.

These and other objects of the present invention will become apparent in light of the present Specification, Claims and Drawings.

SUMMARY OF THE INVENTION

The present invention comprises an erectable container apparatus constructed from a substantially square blank of material for use in releasably storing various articles therewithin.

The apparatus, which may be constructed from a single blank of paperboard material, includes base means for providing an underlying support to one or more of the various articles which are to be releasably stored within the erectable container apparatus. The base means has a top surface, a bottom surface opposite the top surface and at least three peripheral edges. Side panel means have an inner edge operably attached to at least a portion of a corresponding one of each of the at least three peripheral edges of the base means, an outer edge substantially parallel to the inner edge, and a left and right edge operably positioned between the inner and outer edges of each of the side panel means. Each of the left and right edges of the side panel means are operably positioned at an acute angle relative to the inner edge which they operably intersect. Such acute angles serve to provide substantially upright and inwardly sloping side panels after the erectable container apparatus has been articulated into a fully erected orientation, with clean abutting edges, few overlaps and minimized openings at the edges.

A plurality of top flap means each have a proximal end operably attached to a corresponding one of the outer edges of the side panel means, a distal end, and a first and second side end operably positioned between the proximal and distal ends of a corresponding one of the top flap means. The first and second ends of each corresponding one of the plurality of top flap means are operably positioned at an acute angle relative to the outer edge of a corresponding one of the side panel means. At least a portion of each of the plurality of the top flap mean and the side panel means collectively serve to substantially cover the top surface of the base means, and in turn, the articles, when the erectable container apparatus has been articulated into its fully erected orientation.

Locking means are operably associated with at least two of the plurality of top flap means. These locking means serve to lock, as well as to alternatively release, the erectable container apparatus into and from its fully erected orientation respectively.

In the preferred embodiment of the invention, the erectable container apparatus further comprises at least one web means operably attached to the respective right and left edges of adjacently positioned ones of the side panel means. Each of the web means are folded inwardly toward the base means upon articulation of the erectable container apparatus so as to substantially preclude gapping between adjacently positioned ones of the side panel means after the erectable container apparatus has been articulated into its fully erected orientation.

In this preferred embodiment of the invention, the web means each include an apex operably positioned adjacent a portion of the base means and a back edge distally spaced from the apex. The web means further include direction folding means operably and substantially positioned between the apex and the back edge for facilitating the inward folding of the web means upon articulation of the erectable container apparatus toward and into its fully erected orientation.

In the preferred embodiment of the invention, the locking means comprise tab means integrally formed in a portion of one or more of the plurality of top flap means, and, tab receiving means integrally formed in a portion of at least another of the plurality of top flap means. At least a portion of the tab means in the one or more top flap means is releasably engageable within a corresponding tab receiving means in the other top flap means so as to releasably maintain each of the plurality of top flap means and each of the side panel means in their closed, base-covering orientation.

In one preferred embodiment, the tab means is integrally formed at the distal end of one of the plurality of top flap means, and the tab receiving means is integrally formed adjacent the distal end of an opposing one of the plurality of top flap means—without locking devices that require additional blank material through enlargement of the minimal blank configuration.

The locking means may alternatively comprise flap engagement means operably formed in at least two of the plurality of top flap means for releasably engaging a portion of each of the at least two of the plurality of flap means, to, in turn, releasably maintain each of the plurality of top flap means and each of the side panel means in a base and article covering orientation, as well as to lock, and alternatively release, the erectable container apparatus into and from its fully erected orientation respectively.

In this preferred embodiment, the base means comprise four peripheral edges, the side panel means comprise four side panels, the plurality of top flap means comprise four flaps, and the flap engagement means is operably and integrally formed in each of the four flaps. The flap engagement means may also comprise a slit in each of the four flaps, wherein a first two of the slits are operably positioned in two adjacently positioned ones of the four flaps respectively, and a second two of the slits are operably positioned in the other two adjacently positioned flaps. Accordingly, such an orientation will facilitate engageable cooperation with each of the first two adjacently positioned slits, as well as engageable cooperation with the other two of the slits.

In the preferred embodiment of the invention the plurality of top flap means may have a substantially pentagonal configuration, wherein each of the first and second side ends include a lower side edge and an upper side edge meeting at an obtuse angle. Alternatively, the plurality of top flap means may have a substantially triangular configuration, wherein each of the first and second side ends include a lower side edge and an upper side edge which are co-linear. Although such flap means are described as having pentagonal and/or triangular configurations, other configurations are also contemplated.

The construction of the erectable container apparatus is particularly well suited for the containment of hot food, such as pizza, inasmuch as the sloped side panel means serve to minimize the dead space above the pizza otherwise prevalent in non-sloped sided containment devices—while providing suitable venting means as well. In addition, the sloped side panel means further serve to partially crimp the outer edges of the contained food to, in turn, reduce the likelihood of inadvertent movement of the food during transporation.

DETAILED DESCRIPTION OF THE INVENTION

Figure 1:
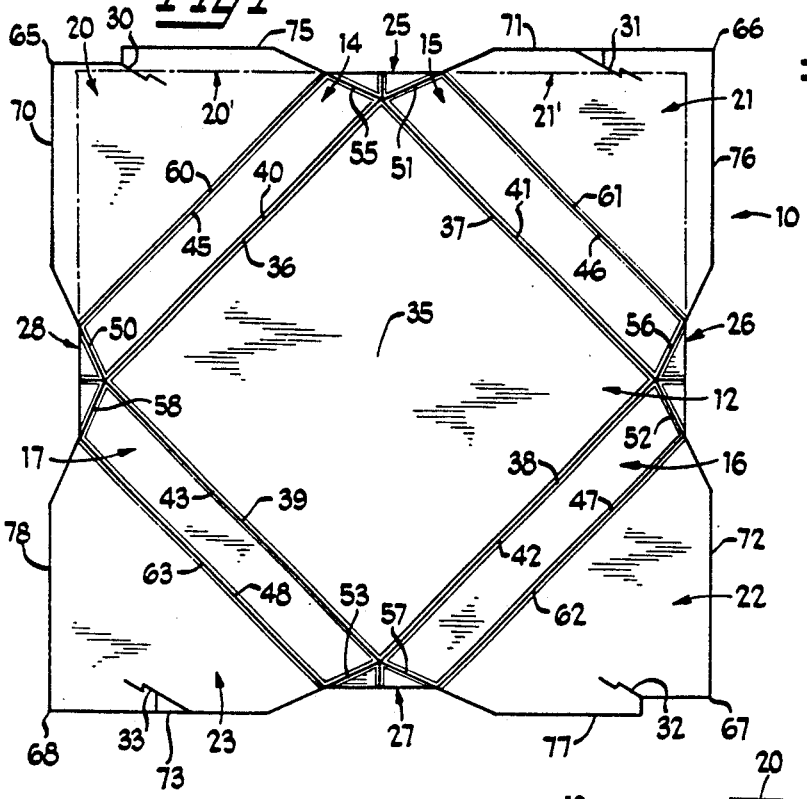
FIG. 1 of the drawings is a top plan view of the erectable container apparatus showing, in particular, the top flap means, the side panel means, the locking means, the web means operably positioned between each of the side panel means, as well as showing the acute angles between the left and right edges of each of the side panel means relative to the respective inner edges to which they operably intersect, and the acute angles between the first and second side ends of the top flap means relative to the corresponding outer edges of the side panels to which they are attached.

While this invention is susceptible of embodiment in many different forms, there is shown in the drawings and will herein be described in detail, several specific embodiments with the understanding that the present disclosure is to be considered as an exemplification of the principles of the invention and is not intended to limit the invention to the embodiments illustrated.

Figure 3:
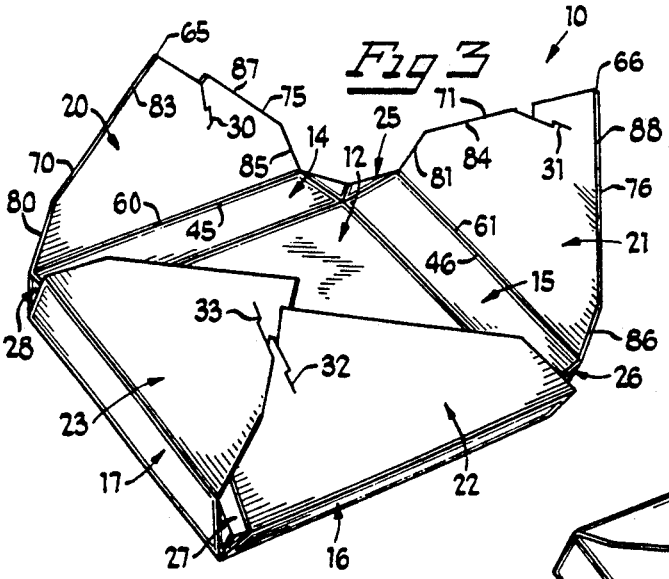
FIG. 3 of the drawings is a perspective view of the erectable container apparatus of FIG. 1 showing, in particular, partial articulation of the apparatus toward and into its fully erected orientation, and, more particularly, showing the intercooperation between the adjacently positioned slitted locking means of corresponding ones of the top flap means.

Erectable container apparatus 10, which is constructed from a substantially square blank of material, is shown in FIGS. 1 and 3 as including base means 12, side panel means 14 through 17, top flap means 20 through 23, web means 25 through 28, and locking means 30 through 33. Base means 12 includes top surface 35, bottom surface (not shown) and four peripheral edges 36 through 39. Side panel means 14 through 17 each include an inner edge, 40 through 43, respectively, an outer edge 45 through 48, respectively, a left edge 50 through 53, respectively, and a right edge 55 through 58, respectively. Each of the inner edges 40 through 43 of side panel means 14 through 17 respectively, are operably attached to a corresponding peripheral edge 36 through 39, respectively, of base means 12.

Figure 2:
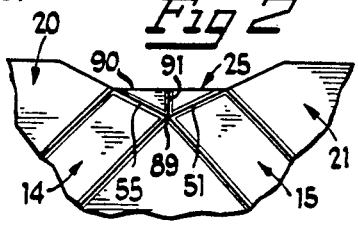
FIG. 2 of the drawings is an enlarged fragmentary view of the erectable container apparatus of FIG. 1 showing, in particular, the acute angles between the left and right edges of the side panel means relative to the respective inner edges to which they operably intersect, as well as showing the web means operably positioned between adjacent ones of the side panel means.
Figure 4:
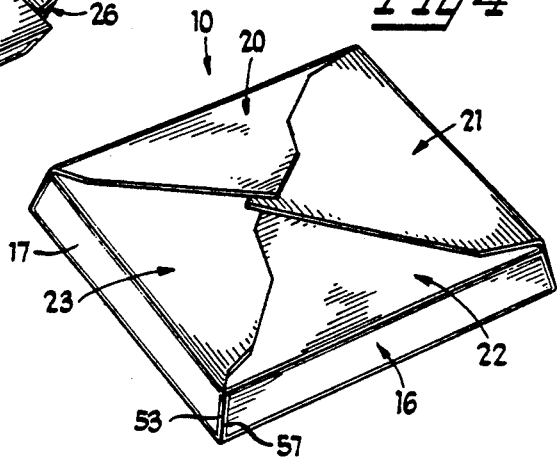
FIG. 4 of the drawings is a perspective view of the erectable container apparatus of FIG. 3 after it has been articulated into its fully erected orientation, showing, in particular, the operable positioning of the top flap means after they have been lockably engaged with each other, as well as showing the substantially upright and inwardly sloping side panel means.

As shown in detail in FIG. 2, the left and right edges, such as left and right edges 51 and 55, respectively, of the side panel means, such as side panel means 15 and 14, respectively, are operably positioned at acute angles relative to the respective inner edges, such as inner edges 41 and 40 (FIG. 1), to which they operably intersect. Accordingly, as shown in FIG. 4, such acute angles enable each of the side panel means to be positioned in a substantially upright and inwardly sloping orientation when erectable container apparatus 10 is in its fully erected orientation.

Top flap means 20 through 23 are shown in FIGS. 1 and 3 as including proximal ends 60 through 63, respectively, distal ends 65 through 68, respectively, first side ends 70 through 73, respectively, and second side ends 75 through 78, respectively. Inasmuch as the top flap means of the embodiment of FIGS. 1 and 3 have a substantially pentagonal configuration, each of the first sides 70 through 73 include a lower side edge, such as lower side edges 80 and 81 (FIG. 3), and an upper side edge, such as upper side edges 83 and 84 (FIG. 3). Likewise, each of the second side edges 75 through 78 also include a lower side edge, such as lower side edges 85 and 86, and an upper side edge, such as upper side edges 87 and 88. As can be seen, each of the corresponding upper and lower side edges connect at an obtuse angle relative to each other. Furthermore, each of the proximal ends 60 through 63 are operably attached to a corresponding one of the outer edges 45 through 48, respectively, of side panel means 14 through 17.

Although top flap means 20 through 23 are shown as having a substantially pentagonal configuration, other configurations, such as triangular, among others, are also contemplated. Indeed, as shown in alternative form in FIG. 1 through dashed lines, such triangular top flaps 20' and 21', each include an upper and a lower side edge, such as upper and lower side edges 85' and 87' (FIG. 1A), respectively. Inasmuch as such top flaps have a triangular configuration, each of the corresponding upper and lower side edges are connected in substantially co-linear relationship relative to each other, as opposed to being connected at an obtuse angle relative to each other. Furthermore, in another embodiment it is contemplated that the side edges of each of the top flap means be substantially co-linear with the back edges, such as back edge 90 (FIG. 2) of an adjacently positioned web means, such as web means 25 (FIG. 2).

As shown in FIG. 1, each of the web means, such as web means 25, are operably attached to a corresponding right edge, such as right edge 55 of one adjacently positioned side panel means, such as side panel means 14, and to a corresponding left edge, such as left edge 51, of another adjacently positioned side panel means, such as side panel means 15. Furthermore, each of the web means, such as web means 25, include an apex, such as apex 89 (FIG. 2), a back edge, such as back edge 90 (FIG. 2), and direction folding means, such as direction folding means 91 (FIG. 2). As shown in FIG. 3, the direction folding means serve to facilitate operable folding of a corresponding web means in a direction toward base means 12 upon articulation of erectable container apparatus 10 toward and into is fully erected orientation (FIG. 4).

After erectable container apparatus 10 has been fully erected, each of the web means will serve to substantially preclude any internal gaps between adjacently positioned ones of the side panel means which would otherwise expose the enclosed internal region of the apparatus to the external environment. As a result, the web means actually serves to enhance the thermal efficiency of erectable container apparatus 10 by reducing, for example, potential heat loss from within the fully erected apparatus after an article, such as hot pizza, has been temporarily stored therewithin, while simultaneously acting as a barrier against the collection and formation of water vapor within the enclosed apparatus. Such a container construction would nonetheless be adequately vented through the release of excess vapors between the top flap side edges, and the open corners of the side panels. Furthermore, inasmuch as the side panel means are sloped inwardly after articulation of apparatus 10 (as previously explained) such heat loss is additionally minimized as a result of the substantial reduction of excessive non-occupied space otherwise prevalent in non-sloped sided containers. Such inwardly sloped side panel means further serves to at least partially crimp the edges of the article, such as a pizza, stored within erectable container apparatus 10 so as to reduce inadvertent shifting of the article during transporting of the apparatus, and, in turn, the article therewithin.

Although back edges, such as back edge 90 (FIG. 2), of the web means are shown as being positioned at an obtuse angle relative to the adjacently positioned lower side edges, such as lower side edges 85 and 81 (FIG. 3), of the corresponding top flap means, such as top flap means 20 and 21, it is also contemplated that such back edges may be positioned at different angles with respect to such lower edges. Indeed, as shown in FIG. 1, the back edges will be substantially co-linear with lower edges shown in dashed lines when top flap means, 20' and 21' have a triangular configuration.

Figure 5:
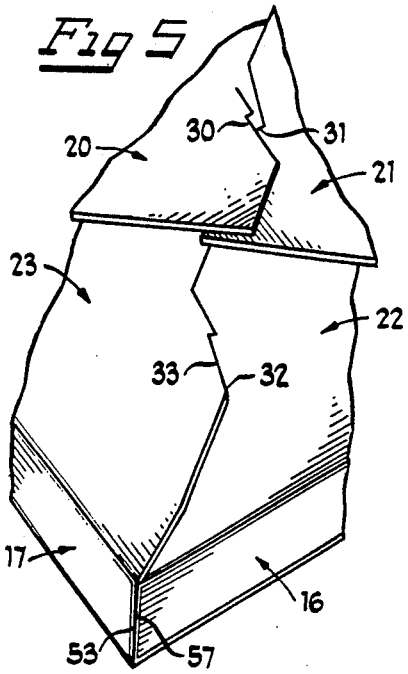
FIG. 5 of the drawings is a fragmentary view of the erectable container apparatus showing, in particular, the operable positioning of each of the top flap means after lockable engagement therebetween, as well as showing the substantially upright and inwardly sloping side panel means.

Locking means 30 through 33 are shown in FIGS. 1, 3 and 5 as comprising a plurality of slits (flap engagement means) integrally formed in a portion of top flap means 20 through 23. In operation, two adjacent ones of the slits 32 and 33 (FIG. 3 and FIG. 5) are lockably engageable with each other, while the other two adjacently positioned slits 30 and 31 are also lockably engageable with each other. Such lockable engagement is accomplished by folding each of the top flap means 20 through 23 adjacent the specific one of the top flap means having the adjacently positioned slit, and then slideably engaging the respective slits with each other—so as to position erectable container apparatus 10 into its fully erected orientation, as shown in FIG. 4. Once erectable container apparatus 10 has been fully erected, each of side panel means, such as side panel means 16 and 17 (FIG. 4 and FIG. 5), will be positioned substantially upright and sloped inwardly toward top surface 35 (FIG. 1) of base means 12. Accordingly, such substantially upright and inwardly sloping side panels in combination with the lockably engaged top flap means, will collectively serve to substantially cover top surface 35 of base means 12.

Figure 1A:
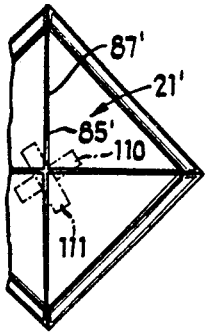
FIG. 1A of the drawings is a fragmentary view of an alternative embodiment of the top flap means showing the substantially triangular configuration of same, as well as showing the locking means operably attached to the top flap means for releasably securing the erectable container apparatus in its fully erected orientation.

Although locking means 30 through 33 (FIG. 1) are shown as being integrally formed in each of the top flap means, it is also contemplated that such locking means be formed in less than all of the top flap means—such as in only two opposing flap means. Furthermore, it is additionally contemplated that such locking means merely be associated with, as opposed to integrated in, the top flap means. For example, as shown in FIG. 1A, such locking means could comprise adhesive strips 110 and 111 operably applied adjacent the distal ends of the top flap means after erectable container apparatus has been articulated toward and into its fully erected orientation.

Figure 6:
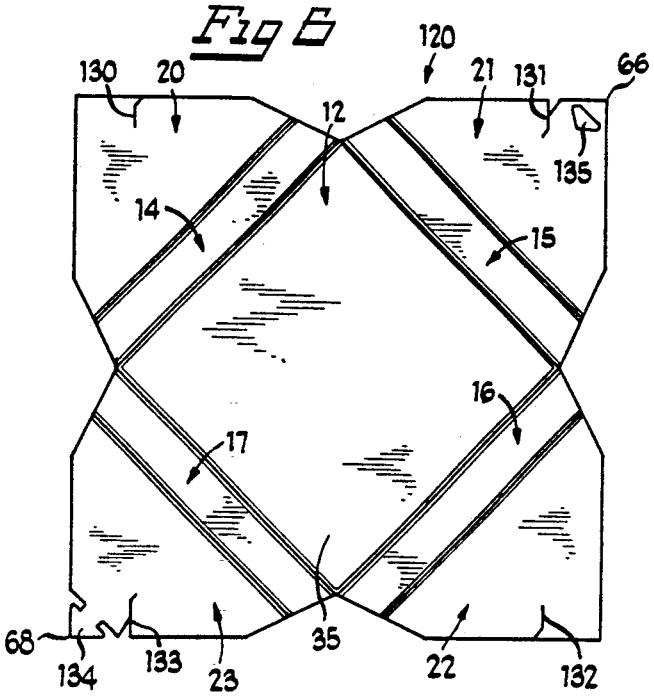
FIG. 6 of the drawings is a top plan view of an alternative embodiment of erectable container apparatus showing, in particular, the substantially pentagonal configuration of the top flap means, the slitted locking means integrally formed in each of the top flap means, as well as the tab means, and tab receiving means integrally formed in the two opposing ones of the top flap means.
Figure 7:
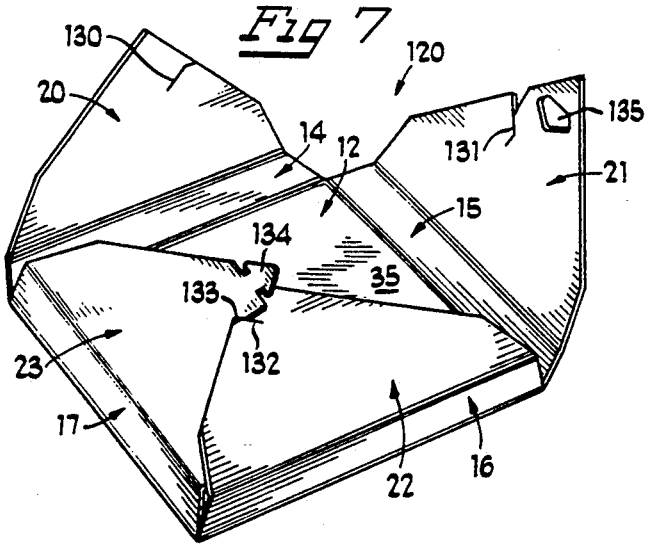
FIG. 7 of the drawings is a perspective view of the erectable container apparatus of FIG. 6 showing, in particular, partial articulation of the apparatus toward and into its fully erected orientation, and, more particularly, showing the intercooperation between the adjacently positioned slitted locking means of corresponding ones of the top flap means.
Figure 8:
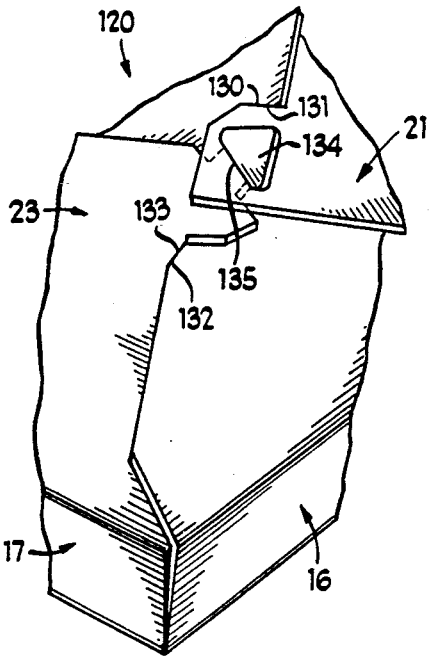
FIG. 8 of the drawings is a fragmentary view of the erectable container apparatus of FIG. 6 showing, in particular, the lockable engagement between the tab means and the tab receiving means.

An alternative preferred embodiment of erectable container apparatus 120 is shown in FIGS. 6 through 8 as being constructed without web means 25 through 28 (FIGS. 1, 2 and 3), as well as being constructed with locking means which are different than those previously described with respect to the embodiments shown in FIG. 1 through FIG. 5. Accordingly, for purposes of simplicity and consistency, like reference numerals, other than with respect to the reference numerals for the locking means, will be utilized for purposes of describing the alternative embodiment of erectable container apparatus 120 shown in FIGS. 6 through 8.

Erectable container apparatus 120 is shown in FIG. 6 and FIG. 7 as including base means 12, side panel means 14 through 17, top flap means 20 through 23 and locking means 130 through 135 (FIG. 8). Locking means 130 through 135 comprise slits 130 through 133 integrally formed in each of the top flap means, as well as tab means 134 and tab receiving means 135. Tab means 134 is integrally formed at distal end 68 of top flap means 23, and tab receiving means 135 is integrally formed adjacent distal end 66 of opposing top flap means 21. Although slits are shown in combination with tab means 134 and tab receiving means 135, it is also contemplated that the locking means comprise only the tab and tab receiving means (without the slits), or, merely the use of slits (without the tab and tab receiving means). It is additionally contemplated that the slits, and/or the tab and tab receiving means, be used in combination with other types of locking means, such as adhesive tape or even staples, as well. Furthermore, although tab means 134 is shown as being inserted through and up tab receiving means 135, it is also contemplated that the tab means be inserted down and through the tab receiving means so as to substantially limit exposure of their respective distal ends.

Lockable engagement of top flap means 20 through 23 (FIG. 7), and, in turn, of erectable container apparatus 120, toward and into its fully erected orientation, is accomplished by folding each of the top flap means toward top surface 35 (FIG. 7) of base means 12 until the slits, such as slits 132 and 133 respectively, and slits 130 and 131 respectively, are adjacently positioned to each other (FIG. 7 and FIG. 8). Once such adjacent positioning has been achieved, each pair of adjacently positioned slits are slideably engaged with each other (FIG. 8). After such slideable engagement has occurred, tab means 134 can be operably inserted into and substantially through tab receiving means 135 (FIG. 8) to, in turn, releasably secure erectable container apparatus 120 in its fully erected orientation—wherein each of the substantially upright and inwardly sloping side panel means and each of the top flap means collectively serve to substantially cover top surface 35 of base means 12.

Although the erectable container apparatus has been shown and described as comprising a single blank of material, it is also contemplated that multiple adjoined blanks be used—provided the collective blank has a substantially square configuration prior to articulation. Furthermore, it is also contemplated that the apparatus be constructed from various foldable materials, such as corrugated and/or non-corrugated paperboard material.

The foregoing description and drawings merely explain and illustrate the invention and the invention is not limited thereto except insofar as the appended claims are limited as those skilled in the art who have the disclosure before them will be able to make modifications and variations therein without departing from the scope of the invention.

What is claimed is:

1. An erectable container apparatus constructed from a substantially square blank of material for use in releasably storing various articles therewithin, said erectable container apparatus comprising:

base means for providing an underlying support to one or more of the various articles to be releasably stored within said erectable container apparatus, said base means having a top surface, a bottom surface opposite said top surface and at least three peripheral edges;

side panel means for operably restraining the position of said articles within said container apparatus, said side panel means having an inner edge operably attached to at least a portion of a corresponding one of each of said at least three peripheral edges of said base means, as well as an outer edge substantially parallel to said inner edge, and a left and right edge operably positioned between said inner and outer edges of each of said side panel means, each of said left and right edges of said side panel means being operably positioned at an acute angle relative to said inner edge to which they operably intersect, for providing substantially upright and inwardly sloping side panels after said erectable container apparatus has been articulated into a fully erected orientation;

a plurality of top flap means for operably covering at least a portion of said base means and said articles, at least one of said plurality of top flap means having a proximal end operably attached to a corresponding one of said outer edges of said side panel means, a distal end, and a first and second side end, wherein said first and second side ends are operably positioned between said proximal end and said distal end of said corresponding one of said plurality of top flap means, said first and second side ends of said at least one of said plurality of top flap means being operably positioned at an acute angle relative to said corresponding one of said outer edge of said side panel means, at least a portion of said plurality of said top flap means and said side panel means collectively serving to substantially cover said top surface of said base means and said articles when said erectable container apparatus has been articulated into said fully erected orientation; and locking means operably associated with at least two of said plurality of top flap means for locking, and, alternatively releasing said erectable container apparatus into and from said fully erected orientation respectively.

2. The erectable container apparatus according to claim 1 wherein the invention further comprises at least one web means each operably attached to said right edge of one of said side panel means and to said left edge of another adjacently positioned one of said side panel means, each of said at least one web means being folded inwardly toward said base means upon said articulation of said erectable container apparatus so as to substantially preclude gapping between adjacently positioned ones of said side panel means after said erectable container apparatus has been articulated into said fully erected orientation.

3. The invention according to claim 2 wherein each of said at least one web means includes an apex operably positioned adjacent a portion of said base means and a back edge distally spaced from said apex;

said web means further including direction folding means operably and substantially positioned between said apex and said back edge for facilitating said inward folding of said web means upon said articulation of said erectable container apparatus toward and into said fully erected orientation.

4. The invention according to claim 2 wherein each of said at least one web means have a triangular configuration.

5. The invention according to claim 1 wherein said locking means comprises tab means integrally formed in a portion of one or more of said plurality of top flap means, and, tab receiving means integrally formed in a portion of at least another of said plurality of top flap means, at least a portion of said tab means in said one top flap means being releasably engageable within said tab receiving means in said another top flap means so as to releasably maintain each of said plurality of top flap means and each of said side panel means in a base covering orientation, as well as to lock, and alternatively release, said erectable container apparatus into and from its said fully erected orientation respectively.

6. The invention according to claim 5 wherein said tab means is integrally formed at said distal end of said one of said plurality of top flap means, and, said tab receiving means being integrally formed adjacent said distal end of an opposing one of said plurality of top flap means.

7. The invention according to claim 1 wherein said locking means comprises flap engagement means operably formed in at least two of said plurality of top flap means for releasably engaging a portion of each of said at least two of said plurality of flap means, to, in turn, releasably maintain each of said plurality of top flap means and each of said side panel means in a base covering orientation, as well as to lock, and alternatively release, said erectable container apparatus into and from its said fully erected orientation respectively.

8. The invention according to claim 7 wherein:

said base means include four peripheral edges, said side panel means comprises four of said side panel means and said plurality of top flap means comprises four flaps;

said flap engagement means being operably formed in each of said four flaps.

9. The invention according to claim 8 wherein said flap engagement means comprises a slit in each of said four flaps, wherein a first two of said slits are operably positioned in two adjacently positioned ones of said four flaps respectively, for engageable cooperation with each other, and a second two of said slits are operably positioned in the remaining two other adjacently positioned flaps respectively, for engageable cooperation with each other.

10. The invention according to claim 1 wherein each of said plurality of top flap means have a substantially pentagonal configuration, each of said first and second side ends including a lower side edge and an upper side edge meeting at an obtuse angle.

11. The invention according to claim 1 wherein each of said plurality of top flap means have a substantially triangular configuration, each of said first and second side ends including a lower side edge and an upper side edge which are co-linear.

12. The invention according to claim 1 wherein said erectable container apparatus is constructed from paperboard material.

13. The invention according to claim 1 wherein the erectable container apparatus is constructed from a single blank of material.

14. The invention according to claim 1 wherein said locking means are integrally formed in at least two of said plurality of top flap means.

* * * * *